US008528303B2

(12) United States Patent
Spatafora

(10) Patent No.: US 8,528,303 B2
(45) Date of Patent: Sep. 10, 2013

(54) EQUIPMENT FOR FEEDING STRIP MATERIAL IN PACKAGING MACHINES

(75) Inventor: Mario Spatafora, Granarolo (IT)

(73) Assignee: G.D S.p.A. (IT)

( * ) Notice: Subject to any disclaimer, the term of this patent is extended or adjusted under 35 U.S.C. 154(b) by 421 days.

(21) Appl. No.: 12/853,946

(22) Filed: Aug. 10, 2010

(65) Prior Publication Data

US 2011/0047935 A1 Mar. 3, 2011

(30) Foreign Application Priority Data

Aug. 28, 2009 (IT) ..... BO2009A0558

(51) Int. Cl.
*B65B 11/00* (2006.01)

(52) U.S. Cl.
USPC ..... 53/389.2; 53/389.4; 53/168

(58) Field of Classification Search
USPC ..... 53/389.1, 389.2, 389.4, 168, 170, 53/135.1–135.3, 136.1, 203, 172; 206/4, 206/21, 112; 224/160.2, 166, 169; 226/4, 226/21, 112, 109; 242/160.2, 166, 169, 566, 242/594, 615.12, 615.51
See application file for complete search history.

(56) References Cited

U.S. PATENT DOCUMENTS 3,225,667 A * 12/1965 Fuchs ..... 493/59
3,948,020 A * 4/1976 Deutsch et al. ..... 53/64
5,040,356 A * 8/1991 Thimon ..... 53/441
6,095,047 A * 8/2000 Dawley ..... 101/417
6,519,914 B1 * 2/2003 Pesho ..... 53/134.1
6,574,939 B1 * 6/2003 Heijnen et al. ..... 53/133.4
6,751,934 B2 6/2004 Focke et al.
2006/0091025 A1 5/2006 Focke et al.

FOREIGN PATENT DOCUMENTS

| | | |
|---|---|---|
| EP | 0967161 | 12/1999 |
| EP | 1225129 | 7/2002 |
| WO | 0248005 | 6/2002 |
| WO | 2005105583 | 11/2005 |

OTHER PUBLICATIONS

Italian Search Report dated Apr. 1, 2010 from corresponding patent application.

* cited by examiner

*Primary Examiner* — Alexandra Elve
*Assistant Examiner* — Adam Moon
(74) *Attorney, Agent, or Firm* — Timothy J. Klima; Shuttleworth & Ingersoll, PLC

(57) ABSTRACT

Strip material used in packaging machines is fed by a rotary support unit carrying a roll of a first or a second strip material, installed downstream of a feed unit supplying a first wrapping material along a first direction toward an operating station where inner wrappers are fashioned for the particular packet in production. The first strip material is decoiled by rollers and guided along the first direction to an operating station where coupons are prepared for inclusion as inserts, placed between the inner and outer wrappers of each packet. The second strip material is taken up and diverted by further rollers along a second direction, such that it is supplied to a cellophaner where it is cut and folded to fashion leaflets applied as onserts to the outer wrapper of each packet before being overwrapped.

5 Claims, 3 Drawing Sheets

EQUIPMENT FOR FEEDING STRIP MATERIAL IN PACKAGING MACHINES

This application claims priority to Italian Patent Application BO2009A000558 filed Aug. 28, 2009, the entirety of which is incorporated by reference herein.

BACKGROUND OF THE INVENTION

The present invention relates to equipment for feeding strip material, intended particularly for use in machines by which cigarettes and products of similar type are packaged.

Conventionally, cigarettes are packaged using automatic machines known as cigarette packers. Packets of cigarettes normally comprise a first inner wrapper of sheet material such as metal foil paper, enveloping a group of cigarettes, and a second outer wrapper of sheet material consisting in cardboard or paperboard, which encloses the inner wrapper and is openable at the top. In the case of rigid cigarette packets, the outer wrapper appears as a box and is furnished internally with a suitably contoured stiffening frame positioned to coincide with the openable top of the packet. Packets of cigarettes are also enveloped typically in an outer layer of flexible and transparent overwrapping material, such as cellophane.

By way of example, patent EP 0967161 illustrates a cigarette packet of the type in question, and a method of manufacturing such a packet. Cigarette packers function generally by feeding a continuous strip of sheet material such as metal foil paper from a roll to an operating station, where single portions of the strip are cut and folded around previously assembled groups of cigarettes to form the inner wrapper aforementioned. The products enveloped in the first inner wrapper are then directed into an operating station where the aforementioned second outer wrapper is added. The packets assembled in this way are then conveyed in line to a cellophaner, by which each one is covered in the aforementioned overwrapping of flexible transparent film.

It is also a common practice to add coupons to the packets, positioned between the first inner wrapper and the second outer wrapper and referred to generically as inserts. The coupons in question are cut from a roll of strip material and fed to a further operating station where each one is applied to the first inner wrapper containing the cigarettes.

Alternatively, packets of cigarettes may include leaflets, referred to as onserts, which are folded and printed with information about the particular product and/or with other sales information of whatever nature. In particular, these folded leaflets are positioned usually between the packet and an overwrapping film of transparent flexible material, in such a way as to remain visible throughout the distribution and shelf life of the unopened packet. More exactly, the folded leaflets are applied generally to packets of cigarettes, typically to the rear face of the packet, before the selfsame packets are overwrapped in the transparent film material.

Patent application IT BO2009A000425 discloses a method and equipment for preparing and applying folded leaflets wherein the single leaflets, cut from a strip material, are folded around respective winding members. Each such winding member is designed to take up and retain a portion of the single leaflet, then caused to rotate in close proximity to a fixed restraint by which the leaflet is engaged and forced to wrap around the winding member.

With cigarette packers currently in use, however, it is not possible to effect a swift and simple changeover from one production method to another, alternately applying coupons (inserts) or leaflets (onserts) to packets as and when required.

The object of the present invention is to overcome the aforementioned drawback by providing equipment that will be capable of feeding strip material used in the application either of coupons, as inserts, or of leaflets, as onserts, to products such as packets of cigarettes and the like, in machines by which products of the type in question are normally packaged.

A further object of the present invention is to provide equipment for use in conjunction with packaging machines capable of high operating speeds.

Yet another object of the invention is to provide equipment characterized by simple design, in terms of construction and operation, such as will be dependable, versatile, and relatively inexpensive to carry into effect.

SUMMARY OF THE INVENTION

The stated objects are realized, according to the invention, in equipment for feeding strip material in packaging machines as recited and characterized in the claims appended.

The equipment according to the present invention comprises a rotary support unit carrying at least one roll of a first strip material or alternatively of a second strip material, positioned in line on the packaging machine, downstream of feed means supplying a first wrapping material decoiled and fed along a first direction toward an operating station at which an inner wrapper of the packet in production is formed. The first strip material is fed by decoiling means along the first direction to an operating station of the packaging machine, where inserts are prepared for application between the inner wrapper and an outer wrapper of each packet. The second strip material can be taken up and routed by diverter means along a second direction, in such a way as to supply the selfsame second strip material to an operating station of a cellophane overwrapping machine for the preparation of leaflets to be applied to the aforementioned outer wrapper of each packet.

In a preferred embodiment of the present invention, the second strip material exiting from the support unit is diverted along a substantially vertical second direction. The diverter means are designed to transfer the second strip material onto a plane of exit from the packaging machine that extends transversely to the longitudinal axis of the selfsame machine.

BRIEF DESCRIPTION OF THE DRAWINGS

A preferred embodiment of the invention will now be described in detail, by way of example, with the aid of the accompanying drawings, in which.

DESCRIPTION OF THE PREFERRED EMBODIMENTS

Figure 1:
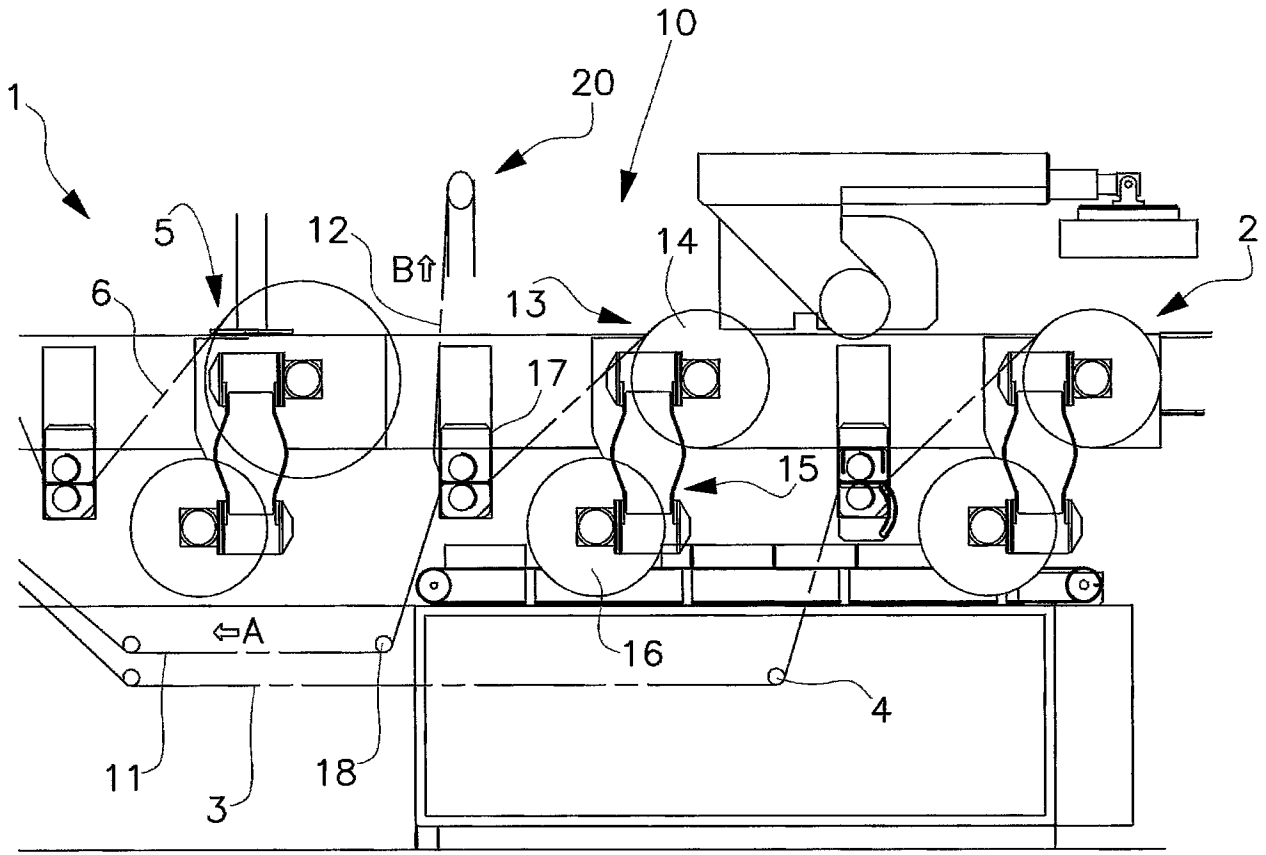
FIG. 1 shows part of a packaging machine, viewed in a front elevation and equipped with equipment for feeding strip material according to the invention.

With reference to the drawings, numeral 10 denotes equipment for feeding strip material, in its entirety, designed specifically for use in a packaging machine 1 such as a cigarette packer, or the like. In particular, the equipment 10 is designed to feed either one of two materials: a first strip material 11 from which to prepare coupons, or inserts, and a second strip material 12 from which to prepare leaflets, or onserts. The packaging machine 1 comprises a feed unit 2 of conventional embodiment supplying a first wrapping material 3, for example metal foil paper, which is used to fashion a first inner wrapper around a group of products (cigarettes) assembled previously in readiness for packaging.

The first wrapping material 3 is caused to advance in a first direction A, along a feed line established by decoil and guide rollers 4, toward an operating station (not illustrated) at which the aforementioned inner wrapper of the packet is fashioned around the products.

Operating downstream of the feed unit 2 supplying the first wrapping material 3 is a feed unit 5 supplying a second wrapping material 6, paperboard for example, from which a stiffening frame will be formed around the inner wrapper of the packet and its contents.

The equipment 10 comprises a rotary support unit 13 carrying a roll 14 of the first strip material 11, or of the second strip material 12. The rotary support unit 13 carrying the roll 14 is installed in line on the packaging machine 1 at a point downstream of the feed unit 2 supplying the first wrapping material 3.

To advantage, the equipment 10 comprises a second rotary support unit 15 carrying a second roll 16 of the first or second strip material 11 or 12, which is designed to take over from the first unit 13 as the first roll 14 nears depletion and thus ensure that production can continue without interruption. Operating downstream of the support units 13 and 15 is a splicing device 17 by which the trailing end of the depleted roll can be joined, in familiar fashion, to the leading end of the new roll.

Exiting from the support unit 13, the first strip material 11 advances along a feed path established by decoil and guide rollers 18, following substantially the same feed direction A as that followed by the first wrapping material 3. The first strip material 11 is supplied to an operating station of the packaging machine 1, where inserts are prepared for placement between the aforementioned inner wrapper and an outer wrapper of each packet, in conventional manner.

Figure 2:
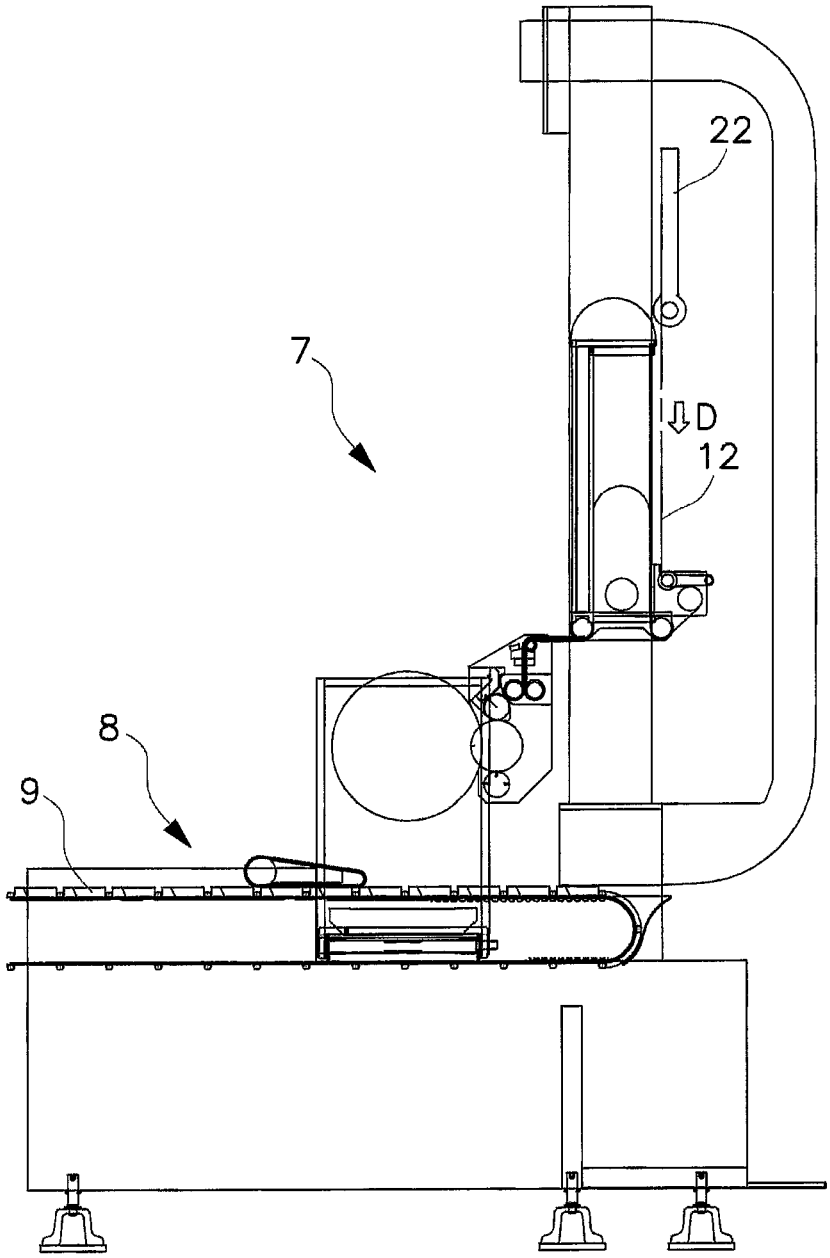
FIG. 2 shows part of a cellophane overwrapping machine supplied with strip material by the equipment according to the invention.

Alternatively, the second strip material 12 exiting the support unit 13 is routed by diverter means 20 along a second, substantially vertical direction B, in such a way as to transfer the selfsame second strip material 12 to an operating station of a cellophane overwrapping machine (not illustrated) where leaflets are prepared for application to the outer wrapper of the packets as onserts. In particular, the second strip material 12 is supplied to equipment 7 by which the leaflets are prepared and applied to the single packets 9 before an overwrapping of cellophane is added; the equipment 7 in question is placed at the entry point of the conveying line 8 carrying the packets 9 to the cellophaner (see FIG. 2). Equipment 7 for preparing and applying the leaflets will be preferably of the type illustrated in Italian patent application BO2009A000425.

Figure 3:
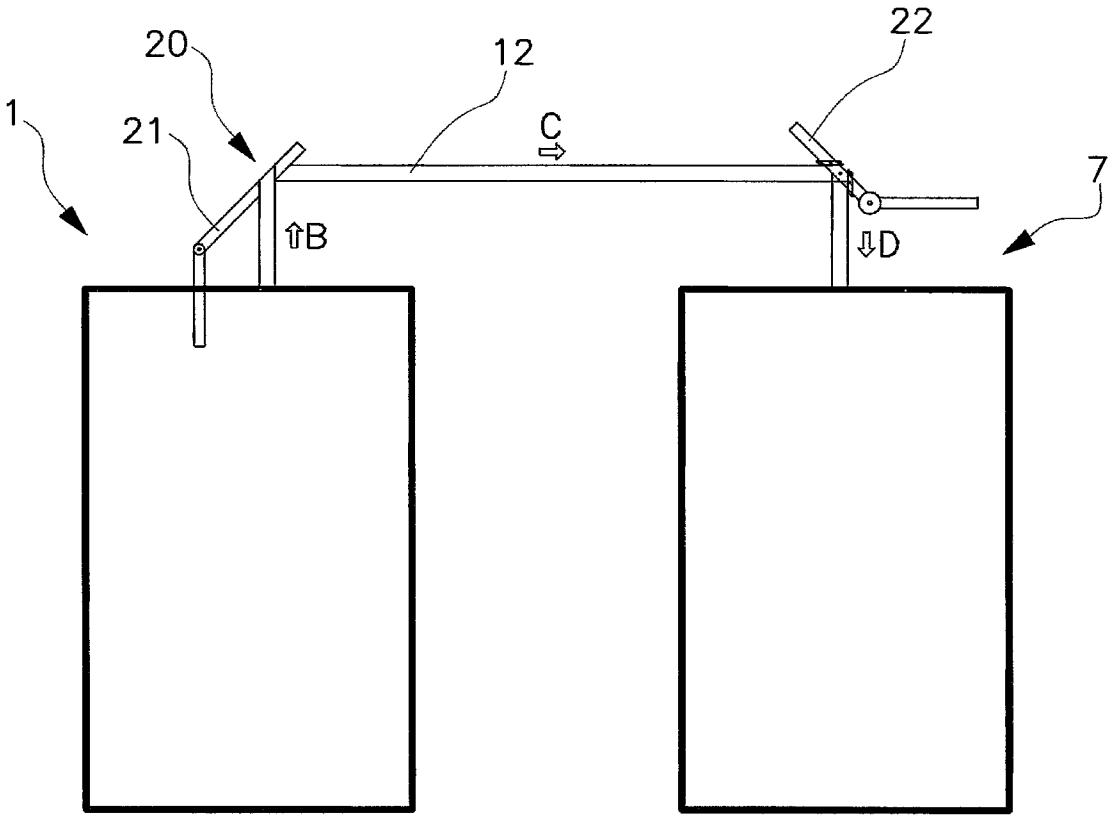
FIG. 3 is a diagrammatic elevation view showing means by which strip material is transferred between the packaging and overwrapping machines.

The second strip material 12 is transferred by the aforementioned diverter means 20 onto a plane of exit from the packaging machine 1 that extends transversely to the longitudinal axis of the selfsame machine. The diverter means 20 comprise a first diverting roller 21 by which the second strip material 12 exiting from the support unit 13 along the second direction B is taken up and guided onto the aforementioned transverse exit plane, advancing substantially in a direction C orthogonal to the second direction B; and a second diverting roller 22 by which the selfsame strip material 12 transferred from the packaging machine 1 is taken up and guided toward the cellophaner, along a substantially vertical direction D (see FIG. 3). The diverting rollers 21 and 22 are suitably inclined, for example at an angle of 45° relative to a vertical axis, converging upwards and aligned on the transverse plane of exit.

For a clearer understanding of the method, FIG. 1 shows both the first strip material 11 used for the preparation of inserts, advancing along the first feed direction A, and the second strip material 12 used for the preparation of onserts, advancing along the second feed direction B. Self-evidently, only one of the two strip materials 11 or 12 will be fed by the equipment when in operation.

The operation of equipment for feeding strip material according to the present invention will be readily discernible from the foregoing description.

The support unit 13 is designed in such a way that a roll 14 of a first strip material 11 or alternatively of a second strip material 12 can be fitted to the packaging machine and used respectively for the preparation either of coupons or of leaflets, to be associated with the packets of cigarettes before the transparent cellophane overwrapping is added.

The first strip material 11 is advanced along the relative feed direction A to the operating station of the cigarette packer where coupons are prepared for application to the packets as inserts, as described above. Alternatively, the second strip material 12 is diverted along the second direction B onto the transverse exit plane and supplied to the equipment 7 by which leaflets are prepared for application to the single packets 9 as onserts, before being overwrapped by the cellophaner.

The stated object of feeding strip material in packaging machines in such a way as to allow the application either of inserted coupons or onserted leaflets to consumer products, and in particular to packets of cigarettes, is duly achieved by the equipment disclosed.

This successful outcome is attributable essentially to the inventive step of equipping the packaging machine with a support carrying a roll of the first or second strip material 11 or 12 and feeding the strip material alternately along different directions A and B either to a station on the packaging machine itself, where coupons are prepared as inserts, or to a station at which leaflets are prepared as onserts and applied to the packets of cigarettes as they approach the cellophane overwrapping machine. In practice, to switch from one type of production to the other, it will be sufficient to replace the roll of first strip material 11 on the support unit 13 with a roll of the second strip material 12 and connect the new strip to the alternative feed means, by which it is then decoiled and supplied to the relative operating station.

One advantage of the equipment disclosed is that it allows a notable simplification and reduction in overall dimensions of the packing and overwrapping system.

Likewise advantageously, the equipment is suitable for use in high-speed packaging machines, as typified by modern cigarette packers.

The equipment described and illustrated by way of example might be embodied differently, according to particular requirements. For example, the support unit might carry a first roll of the first strip material and a second roll of the second strip material simultaneously, the one roll or the other then being used to supply material to the relative operating station for the preparation either of coupons, placed in the packets as inserts, or of leaflets applied to the outer wrapper of the packets as onserts.

What is claimed:

1. Equipment for feeding strip material in a packaging machine, comprising:

a feed mechanism supplying at least a first wrapping material decoiled and guided along a feed line in a first direction toward an operating station at which an inner wrapper of a packet in production is formed;

a rotary support unit carrying a first roll of one at a time a material chosen from a first strip material and a second strip material, operating in line on the packaging machine downstream of the feed mechanism supplying the first wrapping material;

a decoiling mechanism by which the first strip material is fed along the first direction to an operating station of the packaging machine where inserts are prepared for application between the inner wrapper and an outer wrapper of the packet;

a diverter mechanism by which the second strip material is taken up and routed along a second direction different from the first direction, such that the second strip of material can be supplied to a cellophane overwrapping machine and used in the preparation of leaflets for application to the outer wrapper of the packet;

the rotary support unit being configured to feed the first strip material to the decoiling mechanism and the second strip material to the diverter mechanism.

2. The equipment of claim 1, wherein the diverter mechanism transfers the second strip material onto a plane of exit from the packaging machine disposed transversely to a longitudinal axis of the packaging machine.

3. The equipment of claim 2, wherein the second direction is substantially vertical.

4. The equipment of claim 2, wherein the diverter mechanism comprises a first diverting roller for taking up the second strip material exiting from the support unit along the second direction and redirecting the second strip material onto the transverse exit plane, and a second diverting roller for taking up the strip material exiting from the packaging machine and redirecting the second strip material toward the cellophane overwrapping machine.

5. The equipment of claim 4, wherein the diverting rollers are inclined at an angle of 45 degrees relative to a vertical axis and aligned on the transverse exit plane.

* * * * *